US009916947B2

(12) United States Patent
Kornelson

(10) Patent No.: US 9,916,947 B2
(45) Date of Patent: Mar. 13, 2018

(54) UNIVERSAL CONTROL HANDLE

(71) Applicant: Sure Grip Controls, Inc., Saanichton (CA)

(72) Inventor: Brenton A Kornelson, Victoria (CA)

(73) Assignee: SURE GRIP CONTROLS, INC., Saanichton (CA)

( * ) Notice: Subject to any disclaimer, the term of this patent is extended or adjusted under 35 U.S.C. 154(b) by 0 days.

(21) Appl. No.: 15/219,186

(22) Filed: Jul. 25, 2016

(65) Prior Publication Data

US 2018/0025865 A1 Jan. 25, 2018

(51) Int. Cl.
*H01H 9/04* (2006.01)
*H01H 21/10* (2006.01)
*H01H 3/24* (2006.01)

(52) U.S. Cl.
CPC ..... *H01H 21/10* (2013.01); *H01H 3/24* (2013.01)

(58) Field of Classification Search
CPC ..... H01H 21/02; H01H 21/04; H01H 21/10; H01H 25/041; G05G 2009/04774; G05G 9/047
USPC ..... 200/293.1, 6 A; 345/161
See application file for complete search history.

(56) References Cited

U.S. PATENT DOCUMENTS 7,706,916 B2 * 4/2010 Hilton ..... G01L 5/166 345/156
2013/0133469 A1 * 5/2013 Rey ..... G05G 1/06 74/558.5

* cited by examiner

*Primary Examiner* — Vanessa Girardi
(74) *Attorney, Agent, or Firm* — Luedeka Neely Group, P.C.; Rick Barnes

(57) ABSTRACT

A control handle with a mounting portion, having an upper mounting portion and a lower mounting portion. An upper removable portion forms a substantially spherical portion with the upper mounting portion. A control plate is disposed between the upper mounting portion and the lower mounting portion, and control buttons are disposed on the control plate. A lower removable portion forms a substantially cylindrical portion with the lower mounting portion.

19 Claims, 3 Drawing Sheets

UNIVERSAL CONTROL HANDLE

FIELD

This invention relates to the field of controls. More particularly, this invention relates to a universal control handle that can be mounted to shafts of different diameters, and which are disposed in different orientations and heights.

INTRODUCTION

Control handles are used in a variety of different settings. For example, control handles are used in hydraulic equipment, such as to control the operation of various hydraulic systems. One control handle can be used to control the up and down movement of a backhoe, for example, and another can be used to control the movement of the backhoe from right to left. Some control handles combine several sets of controls into the same handle.

It is not unusual to add various hydraulic tools to an existing piece of hydraulic equipment, such as a tractor, backhoe, frontend loader, etc. When a new hydraulic tool is added, a new control handle is often added to control the new tool. For example, a new control handle can be added inside the cab of the piece of hydraulic equipment, where it is easily accessible to the operator.

Often, such a retrofit control handle will be placed on the end of an already existing shaft of some sort within the cab, such as a gear-shift lever. For example, an existing knob can be removed from the end of an existing shaft, and the new control handle can be placed on the end of the shaft.

However, the manufacturer of the control handle does not know in advance the diameter of the shaft on which the control handle will be mounted, and also does not know the angle or elevation of the end of the shaft on which the control handle will be mounted. Because of this, the controls on the control handle might be disposed in a position that is extremely awkward for the operator to use.

These same issues arise when an existing control handle is replaced with a new control handle, such as might occur when the existing control handle is damaged in some way.

What is needed, therefore, is a universal control handle that reduces issues such as those described above, at least in part.

SUMMARY

The above and other needs are met by a control handle with a mounting portion, having an upper mounting portion and a lower mounting portion. An upper removable portion forms a substantially spherical portion with the upper mounting portion. A control plate is disposed between the upper mounting portion and the lower mounting portion, and control switches are disposed on the control plate. A lower removable portion forms a substantially cylindrical portion with the lower mounting portion.

Various embodiments include a compression sleeve disposed between the lower removable portion and the lower mounting portion, for compressing against the shaft. In some embodiments, a set of nesting compression sleeves is disposed between the lower removable portion and the lower mounting portion. In some embodiments, the compression sleeves are formed of slotted cylinders, where an internal diameter of an outer compression sleeve is substantially similar to an external diameter of an inner compression sleeve. In some embodiments, the control switches are at least one of electrical switches, hydraulic switches, and pneumatic switches.

In some embodiments, the control plate is rotatable between the upper mounting portion and the upper removable portion. In some embodiments, the control plate is rotatable when the upper mounting portion and the upper removable portion are apart, and held in place when the upper mounting portion and the upper removable portion are fastened together. Some embodiments include at least one of bolts, screws, snaps, pins, and compression fittings for holding the upper removable portion to the upper mounting portion and the lower removable portion to the lower mounting portion. In some embodiments, the control handle is formed substantially of a thermoplastic resin. In some embodiments, the control handle is formed substantially of metal.

In some embodiments a slot is formed in one of the upper removable portion and the lower removable portion, and a key is formed in another of the upper removable portion and the lower removable portion. The key is slidably retained within the slot when the upper removable portion and the lower removable portion are attached to the upper mounting portion and the lower mounting portion. This arrangement provides structural support to the control handle when the lower mounting portion is clamped against items of different diameters, such as one or more of the nesting compression sleeves.

DRAWINGS

Further advantages of the invention are apparent by reference to the detailed description when considered in conjunction with the figures, which are not to scale so as to more clearly show the details, wherein like reference numbers indicate like elements throughout the several views, and wherein.

DESCRIPTION

Figure 1:
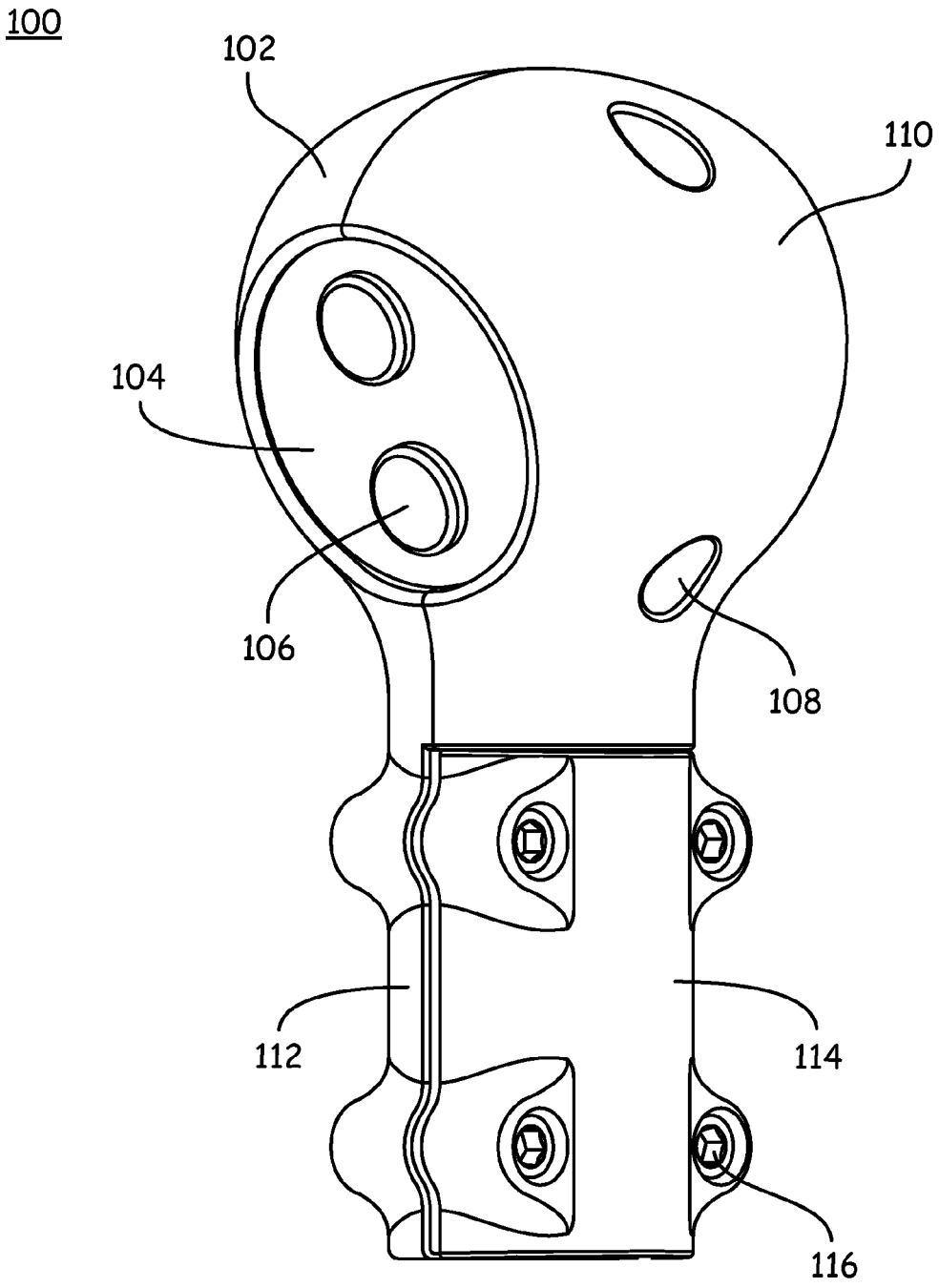
FIG. 1 is a perspective view of a control handle according to an embodiment of the present invention.
Figure 2:
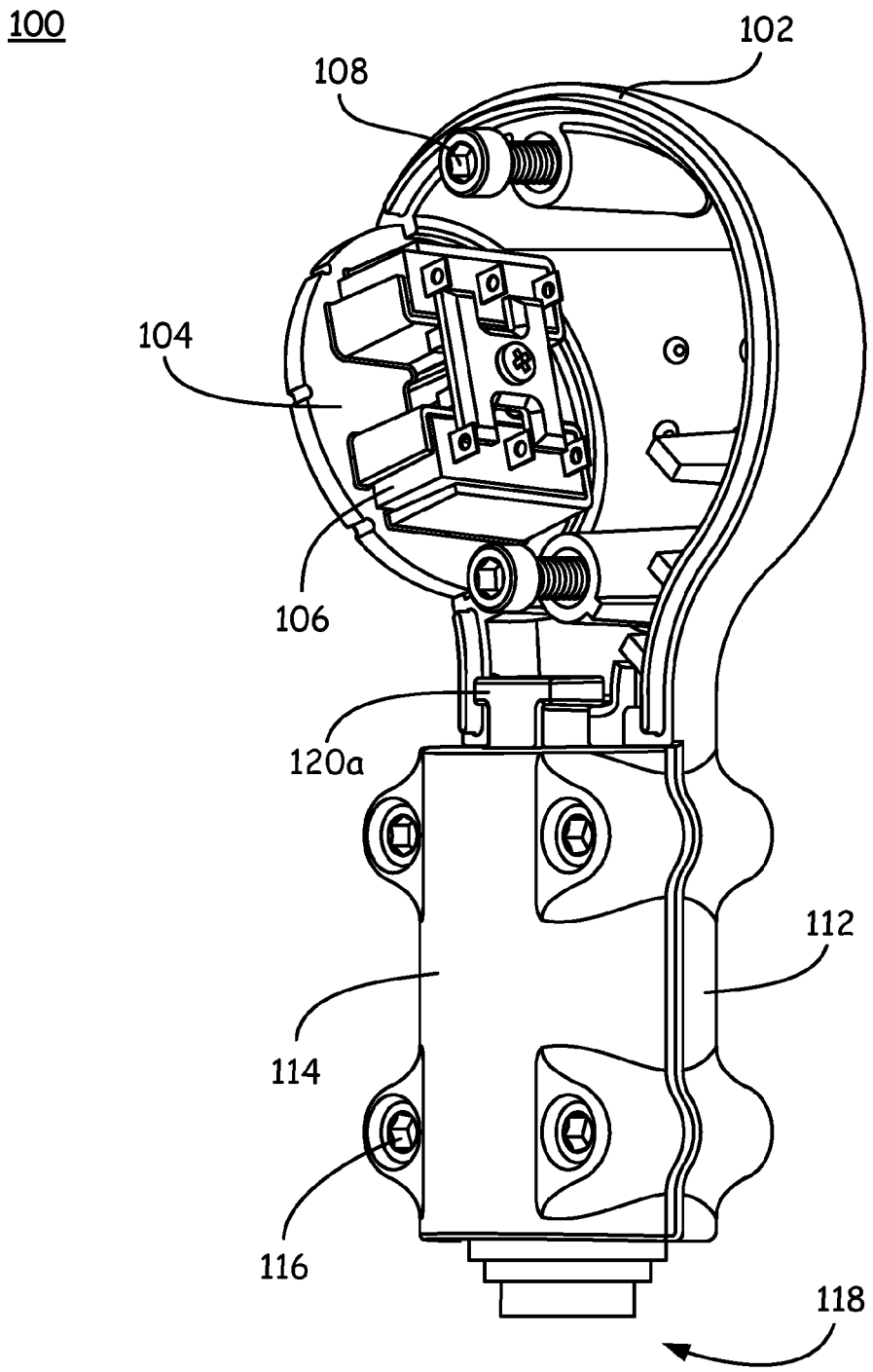
FIG. 2 is a perspective view of a control handle with a first removable portion taken away, depicting various aspects of a face plate of the control handle, according to an embodiment of the present invention.
Figure 3:
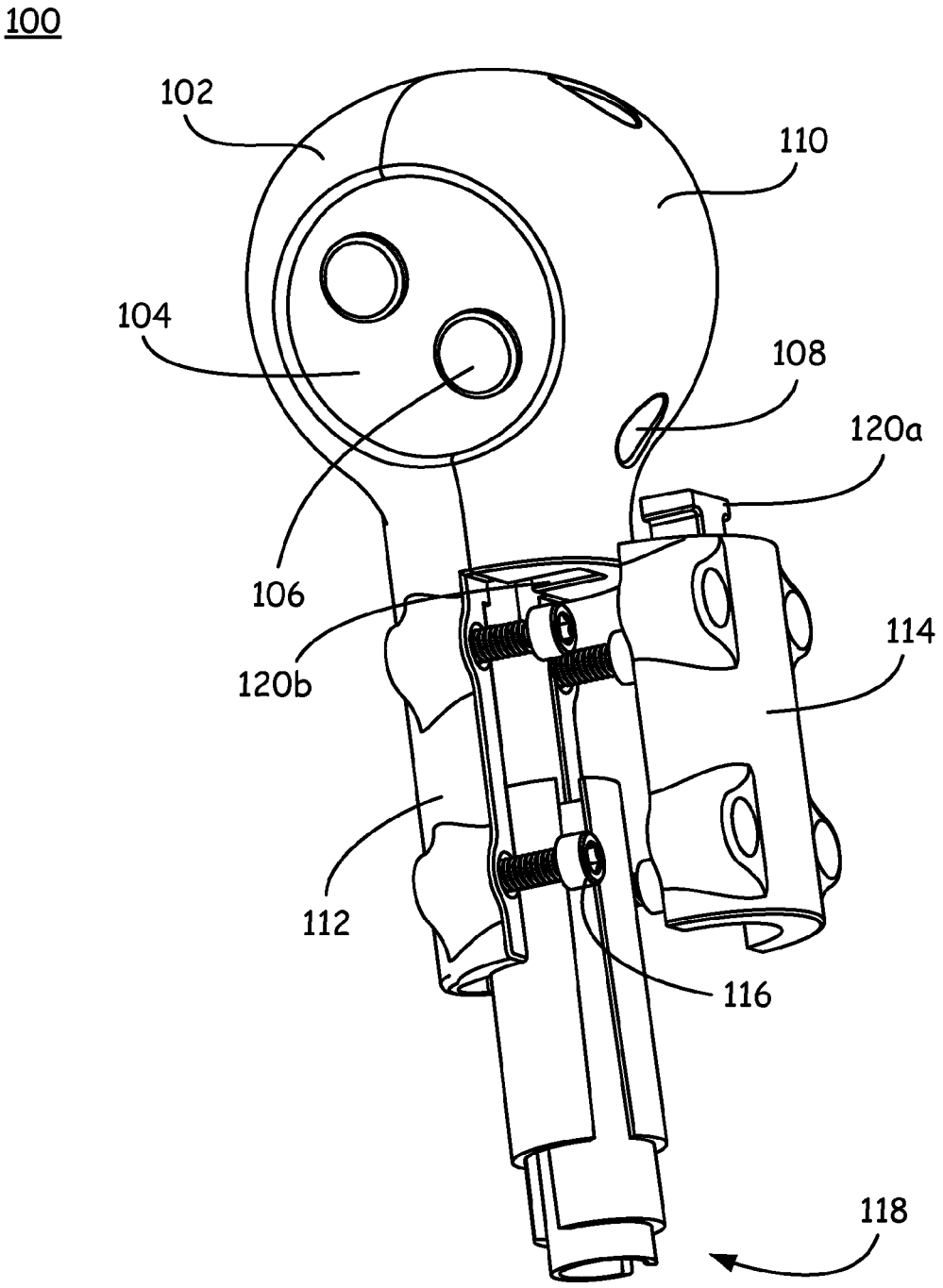
FIG. 3 is a perspective view of a control handle with a second removable portion taken away, depicting various aspects of a clamping mechanism of the control handle, according to an embodiment of the present invention.

With reference now to FIGS. 1-3, there are depicted several views of a universal control handle 100, according to various embodiments of the present invention. The control handle 100 is referred to as universal because it can be adapted to fit posts, poles, or levers of various diameters, which are disposed at different angles, and have ends at different heights, and be rotated so as to provide comfortable and convenient access to the switches that are used to control various aspects of the equipment in which it is mounted.

The control handle 100 has an upper mounting portion 102 to which an upper removable portion 110 is mounted, and a lower mounting portion 112 to which a lower removable portion 114 is mounted, such as with bolts 108 and 116, respectively, or with other fastening hardware such as pins, snaps, screws, or compression fittings. The top part of the control handle 100 is given a generally spherical shape, so that an operator can comfortably rest his hand on or around the control handle 100. The bottom part of the control handle 100 is more cylindrical in shape, and mounts to an existing shaft of some sort, such as in the cab of the equipment, or elsewhere.

The upper removable portion 110 can be loosened from the upper mounting portion 102, to expose an edge of a rotatable control plate 104 that is held firmly and substantially immobile between the upper removable portion 110 and upper mounting portion 102 when they are fastened together. However, when the upper removable portion 110 and the upper mounting portion 102 are loosened one from another, the control plate 104 can be rotated within its recess, thus allowing for alternate positioning of the one or more control switches 106, two of which are depicted in the figures. This enables the control switches 106 to be placed in an orientation that is convenient for use by the operator. By rotating the entire control handle 100 on the shaft to which it is mounted, and rotating the placement of the control switches 106 on the control plate 104, the placement of the control switches 106 can be made very convenient.

Other methods such as a clamping screw could be used to secure the rotatable control plate 104 to one or more of the upper mounting portion 102 and the upper removable portion. Different numbers and orientation of control switches 106 are contemplated herein. In addition, the various embodiments of the invention are not limited to electrical control switches 106, but additional types of control switches are also contemplated, such as hydraulic valves, pneumatic valves, and mechanical linkages, to name just a few.

The lower removable portion 114 can be loosened from the lower mounting portion 112, to expose nesting shaft compression sleeves 118 that are held firmly and substantially immobile between the lower removable portion 114 and lower mounting portion 112 when they are fastened together. However, when the lower removable portion 114 and the lower mounting portion 1102 are loosened one from another, the nesting shaft compression sleeves 118 can be rotated or selectively removed from within its recess, thus allowing compression against mounting shafts of different diameters.

For example, if it is desired to mount the control handle 100 on a relatively small diameter shaft, then perhaps all three of the compression sleeves 118 are used to clamp the control handle 100 onto the shaft using the fasteners 116. However, when it is desired to mount the control handle 100 on a relatively large diameter shaft, then perhaps none of the three compression sleeves 118 are used to clamp the control handle 100 onto the shaft by use of the fasteners 116. Other combinations of compression sleeves 118 for different size shafts are also contemplated, as are different numbers of compression sleeves.

In some embodiments the compression sleeves 118 are slotted, as depicted, so that they can compress to an adjustable range of interior diameters. In some embodiments the compression sleeves 118 are formed of a material that is itself compressible, so as compress and form a tight grip between the control handle 100 and the shaft to which it is mounted, such that the control handle 100 doesn't unintentionally rotate or come off of the shaft to which it is mounted, such as during operation of the equipment.

The lower removable portion 114 in some embodiments is adjustably mounted to the upper removable portion 110, such as with a slot **120*b* and key 120*a* arrangement as depicted in FIGS. 2 and 3, to maintain structural integrity of the control handle 100. The key 120*a* of the lower removable portion 114 is free to slide in the receiving slot 120*b* of the upper removable portions 110, to provide structural support between the lower removable portion 114 and the upper removable portion 110, and to allow for compression of the nesting shaft compression sleeves 118**.

In various embodiments the components of the control handle 100 are formed at least in part of a thermoplastic resin. In other embodiments the components of the control handle 100 are formed at least in part of a metal. Other materials that provide similar structural integrity and resistance to wear and impact are also contemplated.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A control handle, comprising:

a mounting portion, comprising an upper mounting portion and a lower mounting portion, an upper removable portion that with the upper mounting portion forms a substantially spherical portion, a control plate disposed between the upper mounting portion and the lower mounting portion, wherein the control plate is rotatable between the upper mounting portion and the upper removable portion, control switches disposed on the control plate, and a lower removable portion that with the lower mounting portion forms a substantially cylindrical portion, for attachment to a shaft.

2. The control handle of claim 1, wherein the control plate is rotatable when the upper mounting portion and the upper removable portion are apart, and held in place when the upper mounting portion and the upper removable portion are together.

3. A control handle, comprising:

a mounting portion, comprising an upper mounting portion and a lower mounting portion, an upper removable portion that with the upper mounting portion forms a substantially spherical portion, a control plate disposed between the upper mounting portion and the lower mounting portion, control switches disposed on the control plate, a lower removable portion that with the lower mounting portion forms a substantially cylindrical portion, for attachment to a shaft, and a compression sleeve disposed between the lower removable portion and the lower mounting portion, for compressing against the shaft.

4. The control handle of claim 3, wherein the compression sleeve is formed of a slotted cylinder.

5. The control handle of claim 3, wherein the control switches are at least one of electrical switches, hydraulic switches, and pneumatic switches.

6. The control handle of claim 3, further comprising at least one of bolts, screws, snaps, pins, and compression fittings for holding the upper removable portion to the upper mounting portion and the lower removable portion to the lower mounting portion.

7. The control handle of claim 3, wherein the control handle is formed substantially of a thermoplastic resin.

8. The control handle of claim 3, wherein the control handle is formed substantially of metal.

9. The control handle of claim 3, further comprising a slot formed in one of the upper removable portion and the lower removable portion and a key formed in another of the upper removable portion and the lower removable portion, where the key is slidably retained within the slot when the upper removable portion and the lower removable portion are attached to the upper mounting portion and the lower mounting portion, and for providing structural support to the control handle when the lower mounting portion is clamped against items of different diameters.

10. The control handle of claim 3, wherein the compression sleeve comprises a set of nesting compression sleeves disposed between the lower removable portion and the lower mounting portion, for compressing against the shaft.

11. The control handle of claim 10, wherein the compression sleeves are formed of slotted cylinders, where an internal diameter of an outer compression sleeve is substantially similar to an external diameter of an inner compression sleeve.

12. A control handle, comprising:

a mounting portion, comprising an upper mounting portion and a lower mounting portion, an upper removable portion that with the upper mounting portion forms a substantially spherical portion, a control plate disposed between the upper mounting portion and the lower mounting portion, wherein the control plate is rotatable when the upper mounting portion and the upper removable portion are apart, and held in place when the upper mounting portion and the upper removable portion are together, control switches disposed on the control plate, a lower removable portion that with the lower mounting portion forms a substantially cylindrical portion, for attachment to a shaft, at least one of bolts, screws, snaps, pins, and compression fittings for holding the upper removable portion to the upper mounting portion and the lower removable portion to the lower mounting portion, a compression sleeve formed of a slotted cylinder disposed between the lower removable portion and the lower mounting portion, for compressing against the shaft, and a slot formed in one of the upper removable portion and the lower removable portion and a key formed in another of the upper removable portion and the lower removable portion, where the key is slidably retained within the slot when the upper removable portion and the lower removable portion are attached to the upper mounting portion and the lower mounting portion, and for providing structural support to the control handle when the lower mounting portion is clamped against items of different diameters.

13. The control handle of claim 12, wherein the compression sleeve comprises a set of nesting compression sleeves.

14. The control handle of claim 12, wherein the control switches are at least one of electrical switches, hydraulic switches, and pneumatic switches.

15. The control handle of claim 12, wherein the control handle is formed substantially of a thermoplastic resin.

16. The control handle of claim 12, wherein the control handle is formed substantially of metal.

17. A control handle, comprising:

a mounting portion, comprising an upper mounting portion and a lower mounting portion, an upper removable portion that with the upper mounting portion forms a substantially spherical portion, a control plate disposed between the upper mounting portion and the lower mounting portion, wherein the control plate is rotatable when the upper mounting portion and the upper removable portion are apart, and held in place when the upper mounting portion and the upper removable portion are together, control switches disposed on the control plate, a lower removable portion that with the lower mounting portion forms a substantially cylindrical portion, for attachment to a shaft, at least one of bolts, screws, snaps, pins, and compression fittings for holding the upper removable portion to the upper mounting portion and the lower removable portion to the lower mounting portion, a set of nesting compression sleeves, each compression sleeve formed of slotted cylinder, disposed between the lower removable portion and the lower mounting portion, for compressing against the shaft, and a slot formed in one of the upper removable portion and the lower removable portion and a key formed in another of the upper removable portion and the lower removable portion, where the key is slidably retained within the slot when the upper removable portion and the lower removable portion are attached to the upper mounting portion and the lower mounting portion, and for providing structural support to the control handle when the lower mounting portion is clamped against items of different diameters.

18. The control handle of claim 17, wherein the control switches are at least one of electrical switches, hydraulic switches, and pneumatic switches.

19. The control handle of claim 17, wherein the control handle is formed substantially of at least one of thermoplastic resin and metal.

* * * * *